US006794569B2

(12) United States Patent
Kamijima et al.

(10) Patent No.: US 6,794,569 B2
(45) Date of Patent: Sep. 21, 2004

(54) ACOUSTIC INSTRUMENT TRIGGERING DEVICE AND METHOD

(75) Inventors: Yuujirou Kamijima, Inasa-gun (JP); Kiyoshi Yoshino, Hamamatsu (JP)

(73) Assignee: Roland Corporation, Osaka (JP)

( * ) Notice: Subject to any disclaimer, the term of this patent is extended or adjusted under 35 U.S.C. 154(b) by 0 days.

(21) Appl. No.: 10/345,128

(22) Filed: Jan. 14, 2003

(65) Prior Publication Data

US 2004/0134332 A1 Jul. 15, 2004

(51) Int. Cl.[7] ..... G10H 3/00; G10H 1/32
(52) U.S. Cl. ..... 84/746
(58) Field of Search ..... 84/723, 746

(56) References Cited

U.S. PATENT DOCUMENTS

| | | | | | |
|---|---|---|---|---|---|
| 729,936 | A | | 6/1903 | Heybeck | |
| 3,748,367 | A | | 7/1973 | Lamme et al. | |
| 4,226,156 | A | * | 10/1980 | Hyakutake | 84/730 |
| 4,279,188 | A | | 7/1981 | Scott | |
| 4,362,081 | A | | 12/1982 | Hartry | |
| 4,581,973 | A | | 4/1986 | Hoshino | |
| 4,717,002 | A | | 1/1988 | Sasamura | |
| 4,798,121 | A | | 1/1989 | Donohoe | |
| 4,828,907 | A | | 5/1989 | Hayashi | |
| 4,947,725 | A | | 8/1990 | Nomura | |
| 5,036,742 | A | * | 8/1991 | Youakim | 84/411 R |
| 5,042,356 | A | | 8/1991 | Karch | |
| 5,134,920 | A | * | 8/1992 | Clark | 84/730 |
| 5,345,037 | A | * | 9/1994 | Nordelius | 84/730 |
| 5,449,964 | A | | 9/1995 | Snyder | |
| 5,533,405 | A | | 7/1996 | Hoshino | |
| 5,585,581 | A | | 12/1996 | Rogers | |
| 5,633,473 | A | | 5/1997 | Mori et al. | |
| 5,977,473 | A | * | 11/1999 | Adinolfi | 84/723 |
| 6,121,528 | A | * | 9/2000 | May | 84/411 R |

FOREIGN PATENT DOCUMENTS

| | | |
|---|---|---|
| DE | 196 25 570.8-51 | 1/1998 |
| JP | 2-117569 | 9/1990 |
| JP | 2003-173186 | 6/2003 |

OTHER PUBLICATIONS

20 Pages of machine translation of JP2003–173186 obtained from Japanese Patent Office Website—document has been translated by computer and may not reflect the original filing completely.

* cited by examiner

*Primary Examiner*—Jeffrey Donels
(74) *Attorney, Agent, or Firm*—Foley & Lardner LLP

(57) ABSTRACT

An acoustic instrument triggering device has a body portion that may be mounted on an acoustic or example, a drum. An arm extends from the body portion. A sensor, which includes, a transducer, is disposed in the arm and is adjustable so that the cushion portion make contact with a drum head or other vibrating portion of the instrument. A cushion portion transfers vibrations to the transducing element, which in tun transduces the vibrations into electrical signals that can be processed to form an audio signal or used to trigger other devices.

17 Claims, 9 Drawing Sheets

ACOUSTIC INSTRUMENT TRIGGERING DEVICE AND METHOD

BACKGROUND

1. Field of the Invention

The present invention relates to triggering devices and methods for acoustic instruments and, in particular embodiments, to such devices and methods capable of fitting or adjusting to fit multiple different instruments. In example embodiments, such triggering devices and methods are configured to attach to an acoustic drum instrument for transducing mechanical vibrations on acoustic drum heads into electrical signals.

2. Related Art

Electronic drums having sensors for sensing movement or vibrations of a drum head have become commonplace. Typically, electronic drums are fabricated such that the playing surface of the drum, i.e., the drum head or drum skin, resembles the look and feel of an acoustic drum. However, positioned underneath the drum head is a transducer, such as a piezoelectric transducer, for example, that responds to the movement of the drum head. When a drummer strikes the drum, the vibrations induced in the skin of the drum are transduced into an electrical signal by the transducer. The electrical signal is then used to trigger other devices or is otherwise processed by signal processing equipment. Electronic drums are used in a variety of playing situations, both in the studio and live.

Electronic drums require fabrication techniques far more sophisticated than those needed for acoustic drums. Whereas an acoustic drum is essentially a drum skin pulled tightly over a frame, an electronic drum is a precise electronic sensing instrument, having not only a specially fabricated drum skin and frame, but also a sophisticated sensing element and communication link as well.

Such technological sophistication carries with it a commensurate price tag. Many drummers without the resources to afford multiple drum sets must choose between an acoustic drum set and an electronic drum set. Although an electronic drum set may prove more versatile, offering the drummer a wide variety of sounds that can be triggered by striking the skin of one of the electronic drums, the cost associated with electronic drum sets often forces many a drummer to purchase a less expensive acoustic drum set.

Transducing an acoustic signal into an electrical signal is also common in the musical arts. Guitarists, for example, routinely place pickups on their acoustic guitars, either in the soundhole of the guitar to sense the vibrations of the strings or on the body of the guitar itself to sense the vibrations of the guitar's body as sound waves resonate within the interior of the guitar. Transducing elements have also been available to drummers. For example, transducing elements that have been affixed to a drum head sense vibrations in the skin and transduce the vibrations into an electrical signal that can be used to trigger other devices or can otherwise be processed.

While transducing elements have been available for attaching to acoustic instruments, each such transducing elements are generally designed for a particular instrument and particular instrument size. Accordingly, different transducers have been designed for different instruments and for different sizes, for example, for different size drums. As a result, the cost of manufacturing such transducers for a variety of instruments of different type or size can be relatively high. In addition, due to the relatively strong force with which drummers typically strike drums, prior acoustic drum transducers may be easily displaced from their original positions and become ineffective to sense the vibrations of the drum head. In addition, in some prior devices, the contact between the transducer and the drum head dampens or muffles the sound of the drum itself, and the resulting detriment to the audible and physical feedback to the drummer can result in a poor playing performance.

SUMMARY

It is therefore an object of embodiments of the present invention to provide a triggering device for an acoustic instrument that may operate with a variety of instruments of different types or different sizes.

It is another object of embodiments of the present invention to provide a triggering device for an acoustic instrument that maintains its position under adverse conditions and does not compromise the integrity of the sound or the feel of the acoustic instrument.

It is yet another object of embodiments of the present invention to provide a triggering device for an acoustic instrument that is relatively easy to install and use.

According to embodiments of the present invention, a triggering device for an acoustic instrument may include a body, an arm fixedly attached to the body; and a sensor for sensing mechanical vibrations. The sensor may be removably attached to the arm. The triggering device may be mountable on a vibrating device and the sensor may transduce a mechanical vibration into an electrical signal.

The body may include a flange and a body screw adjacent the flange. The body screw may be rotatable toward the flange for mounting the body. The arm may include a receiving area for receiving the sensor and an arm screw passing through the arm. The arm may tighten against the sensor when the arm screw is rotated. The sensor may include a shaft, a sensor body fixedly attached to the shaft, a cushion fixedly attached to the sensor body and a transducing element disposed between the cushion and the sensor body.

The sensor may further include a projection located on the shaft and a projection disposed on the sensor body. The body may further include a body slit disposed on the flange. The arm may further include an arm slit disposed adjacent the receiving area. The body slit may accept the projection and the arm slit may accept the projection.

A position of the sensor within the arm may be adjustable. Moreover, the cushion may contact the vibrating device. Vibrations from the vibrating device received by the cushion may be transferred to the transducing element. The transducing element may transduce the vibrations into electrical signals. The transducing element may send the electrical signals to a jack on the body.

DETAILED DESCRIPTION

In the following description of preferred embodiments, reference is made to the accompanying drawings which form a part hereof, and in which are shown by way of illustration specific embodiments in which the invention may be practiced. It is to be understood that other embodiments may be utilized and structural changes may be made without departing from the scope of the preferred embodiments of the present invention.

Although the following description is directed primarily toward an acoustic instrument triggering device that generates electrical or electronic signals from an acoustic drum set, embodiments of the present invention may be used in a variety of capacities. For example, embodiments of the present invention may be adapted for use on any percussion instrument. Embodiments of the present invention may also be adapted for use with stringed instruments. For example, embodiments of the present invention may be employed on banjos or dobros.

Figure 1:
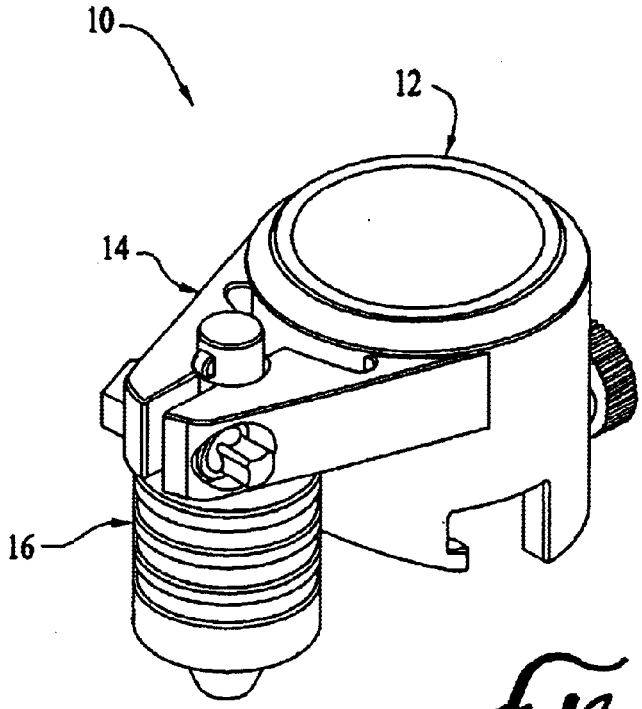
FIG. 1 shows a generalized acoustic instrument triggering device according to an embodiment of the present invention.
Figure 2:
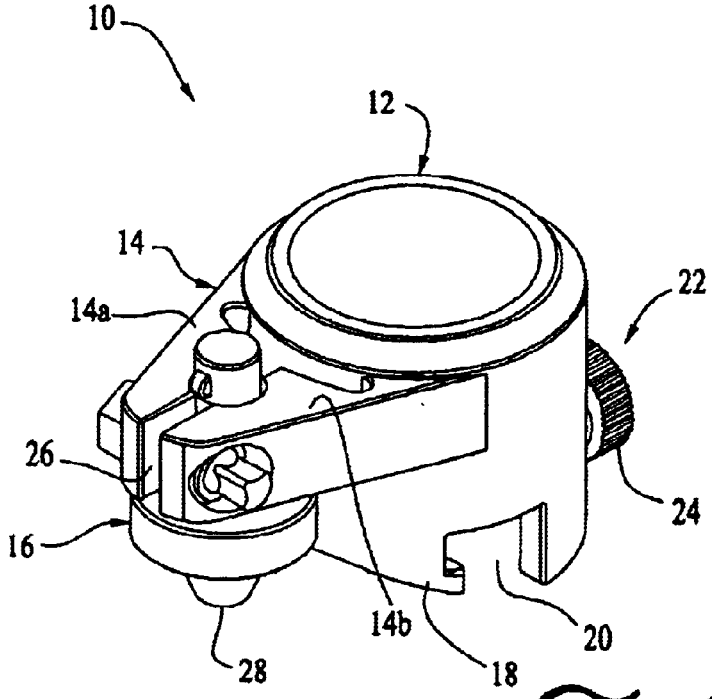
FIG. 2 shows a generalized acoustic instrument triggering device according to another embodiment of the present invention.

A generalized acoustic instrument triggering device 10 according to an embodiment of the present invention is shown in FIG. 1. The embodiment of the acoustic instrument triggering device 10 shown in FIG. 1 includes, without limitation, a body 12, an arm 14 and a sensor 16. A generalized acoustic instrument triggering device 10 according to an another embodiment of the present invention may be seen in FIG. 2. The embodiment of the acoustic instrument triggering device 10 seen in FIG. 2 also includes a body 12, an arm 14 and a sensor 16. However, the sensor 16 in the embodiment of the invention shown in FIG. 2 is of a shorter length than the sensor 16 shown in the embodiment of the invention shown in FIG. 1. The acoustic instrument triggering device 10 according to embodiments of the present invention is configurable to accept a variety of sensors 16, including, without limitation, sensors 16 of different lengths, as shown in FIGS. 1 and 2, for example, to accommodate different instruments or different instrument sizes.

The body 12 includes a flange portion 18 and channel 20. A screw 22 has a threaded shaft extending through a threaded aperture in the body 12, such that one end of the screw is capable of extending at least partially into the channel 20 toward the flange portion 18. The opposite end of the screw 22 may have a knob 24 or other hand-operable feature to allow a user to easily rotate the screw by hand. As described below, the screw 22 is part of a mechanism for securing the body 12 to an instrument. Other suitable mechanisms for securing the body to an instrument may be employed in other embodiments of the invention.

The arm 14 includes a first arm section 14*a* and a second arm section 14*b*, separated by a gap or slit 26. The arm 14, including each arm section 14*a* and 14*b*, has one end coupled to the body 12 and a second end extended outward from the body 12. As described below, the arm 14 is configured to hold the sensor 16, in a selectable, fixed position, on the instrument. The sensor 16 may include a piezoelectric element, for creating electrical signals from vibrations created by a user playing the instrument. In the illustrated embodiments, the sensor 16 also includes a cushion member 28, to help convey vibrations to the piezoelectric element. In other embodiments, the sensor 16 may comprise other suitable sensing configurations.

Figure 3:
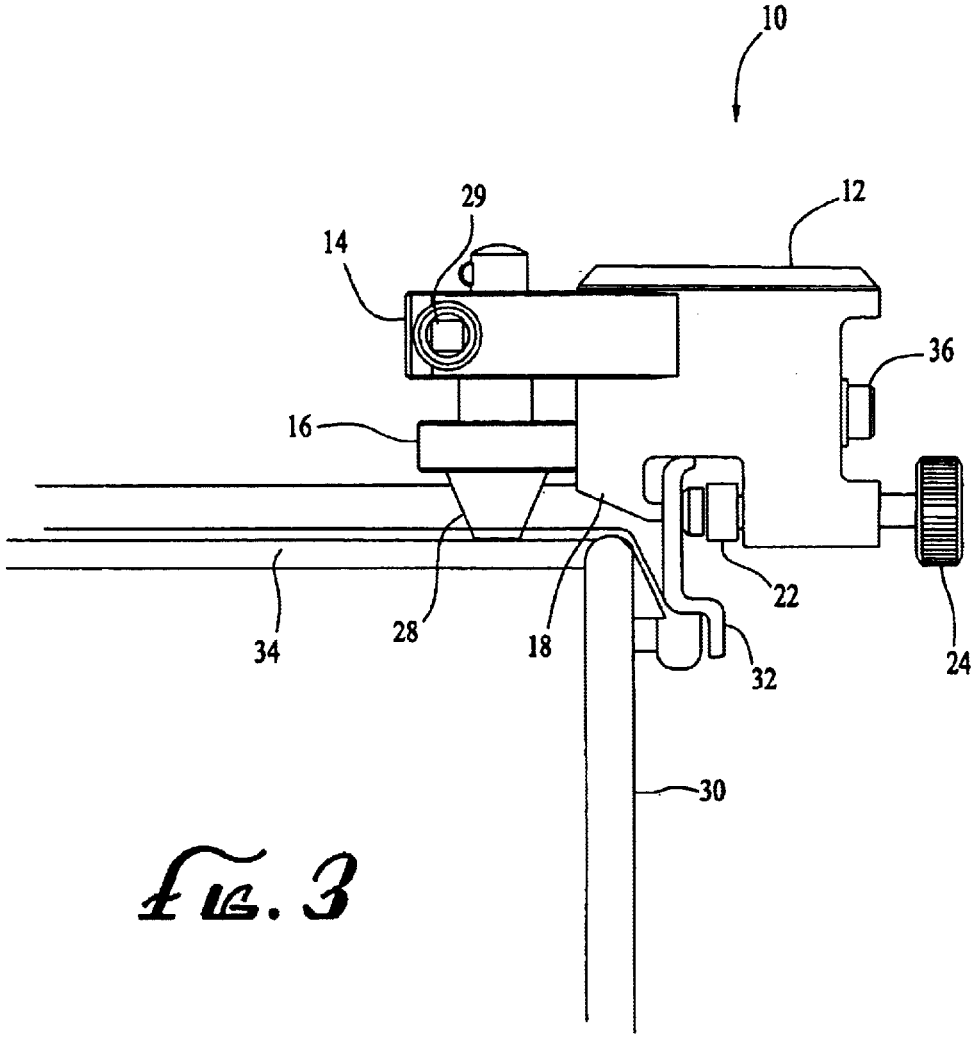
FIG. 3 shows an acoustic instrument triggering device positioned on a snare drum according to an embodiment of the present invention.

FIG. 3 shows an acoustic instrument triggering device 10 positioned on a snare drum 30. As shown in FIG. 3, the body 12 may be positioned around a rim 32 of the snare drum 30 such that the rim 32 is disposed between a first end of the screw 22 and the flange 18. When placed in a desired position, the knob 24 on the second end of the screw 22 may be rotated so that the screw 22 and the flange 18 tighten against the rim 32, to hold the body 12 in place, in a fixed relation relative to the rim 32. By turning the knob 24, the first end of the screw 22 will extend further into the channel 20 and force the rim of the drum against the flange 18, thereby fixing the position of the body 12 relative to the rim 32 of the drum.

Next, the position of the sensor 16 in the arm 14 may be adjusted so that a cushion 28 makes contact with a drum head 34 of the snare drum 30. When the sensor 16 is in the desired position, an arm screw 29 may be tightened to fix the position of the sensor 16, relative to the drum head 34. The ability to adjust the sensor position relative to the arm 14 and body 12 of the triggering device 10, allows the triggering device 10 to fit and operate with a variety of different drum sizes, as described below.

In FIG. 3, when a drummer strikes the drum head 34, causing it to vibrate, the sensor 16 will receive the vibration through the cushion 28. The cushion 28 will transfer the vibrations to the transducing element of the sensor for transducing the vibrations into an electrical signal. The electrical signal is made available at the jack 36. Once available at the jack 36, the electrical signal can be used to trigger other devices or can otherwise be processed by signal processing equipment, by suitably connecting such devices or equipment to the jack 36.

Figure 4:
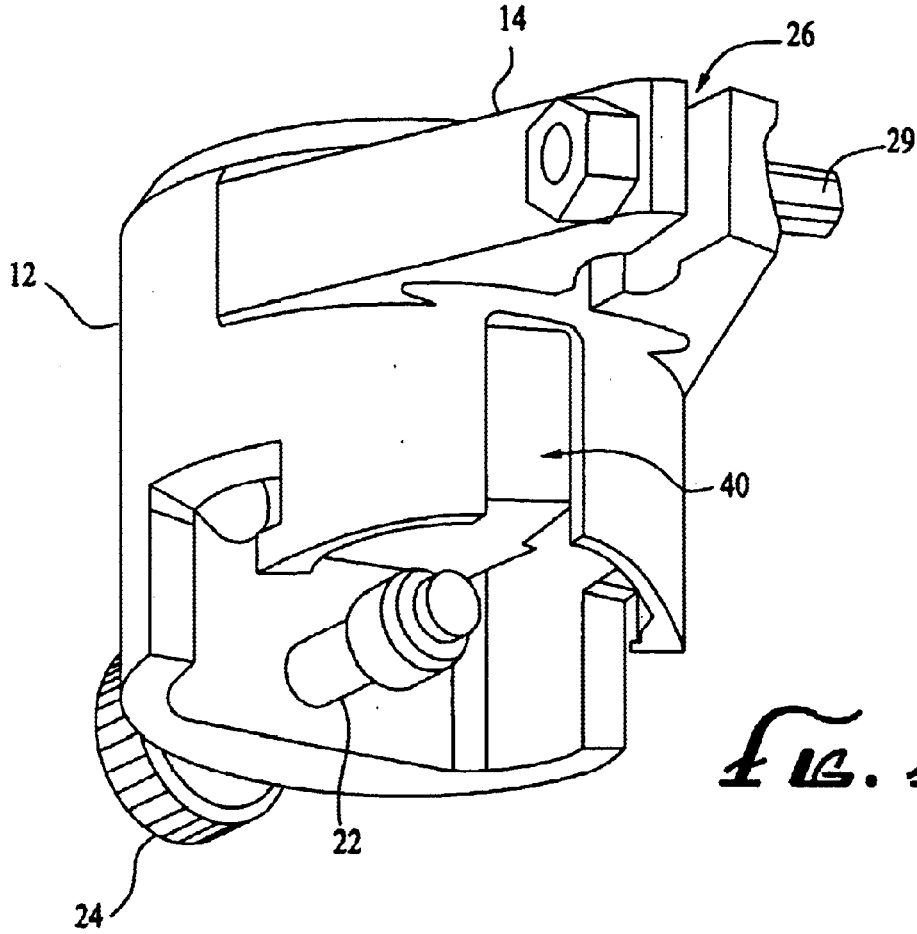
FIG. 4 shows a portion of an acoustic instrument triggering device showing additional features of a body and an arm according to an embodiment of the present invention.

FIG. 4 shows a portion of an acoustic instrument triggering device 10 according to an embodiment of the present invention may be seen in FIG. 4. FIG. 4 shows a body 12 and an arm 14 without the sensor 16. When a sensor 16 is disposed in the arm 14, between the arm sections 14*a* and

14*b*, the arm screw 26 may be tightened so that the arm sections 14*a* and 14*b* squeeze and grip the sensor, thereby holding it in place and maintaining the position to which it has been set. The body 12 may include a gap or slit 40 that may be used to prevent rotation of the sensor 16 in the horizontal plane, as will be explained in more detail below.

In the embodiment of the invention shown in FIG. 4, the arm 14 tapers as it extends from the body 12 to the arm screw 26. Thus, in this embodiment, the arm sections 14*a* and 14*b* can accommodate a relatively wide body 12 at one end and a narrower sensor 16 at another end.

Figure 5:
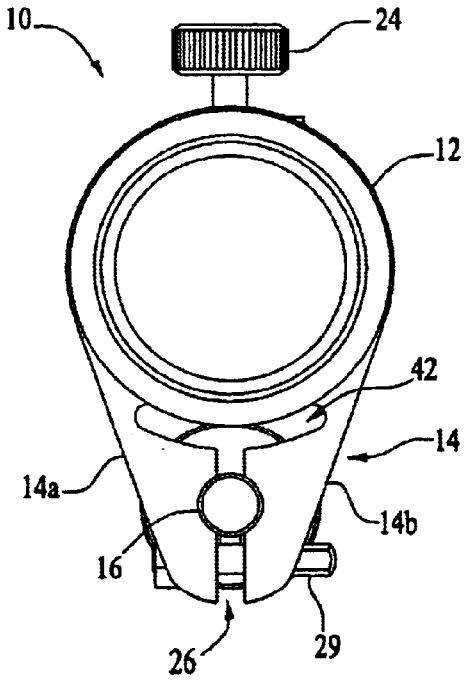
FIG. 5 shows a top-down view of an acoustic instrument triggering device according to an embodiment of the present invention.

A "top-down" view of an acoustic instrument triggering device 10 according to an embodiment of the present invention is shown in FIG. 5. FIG. 5 shows the relative positioning of the body 12, the arm 14 and the sensor 16. The body 12 may be made from a variety of materials, including, but not limited to metal, alloys, plastics, PVC, combinations thereof and the like. The body 12 may also be configured into a variety of shapes and sizes. For example, according to an embodiment of the present invention as shown in FIG. 5, the body 12 is configured generally in a circular cylinder. However, the body 12 may take the shape of a square, cube, rectangle or any other shape that will facilitate its mounting onto a desired device.

The knob 24 shown in FIG. 5 may also be configured in a variety of shapes and sizes. For example, as shown in FIG. 5, the knob 24 is generally circular and is disposed relatively close to the body 12. However, the knob 24 may extend farther away from the body 12 than is shown in FIG. 5 if desired by the user. Additionally, according to embodiments of the present invention, the knob 24 may be fabricated to any diameter convenient for a user, for example, to grip between a thumb and fore-finger.

Figure 6:
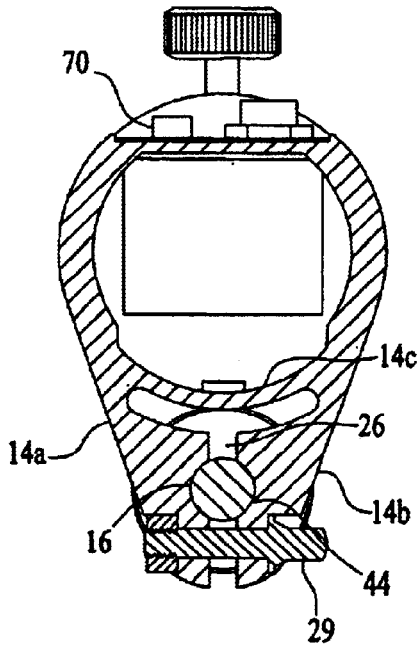
FIG. 6 shows a cutaway view of the acoustic instrument triggering device shown in FIG. 5 according to an embodiment of the present invention.

The arm 14 shown in FIG. 6 includes first and second arm sections 14*a* and 14*b* separated by a gap or slit 26. The arm sections 14*a* and 14*b* extend from a backiron section 14*c* of the arm 14. The aperture 42 is located at one end of the gap or slit 26 and improves the ability of the arm sections 14*a* and 14*b* to be drawn together or separated by action of the screw 29 and the natural resilience of the material from which the arm 14 is made.

A cross-section view of an acoustic instrument triggering device 10 according to an embodiment of the present invention is shown in FIG. 6. The cross-section view of FIG. 6 is taken from FIG. 5. The arm 14 includes an aperture 42. The screw 29 is located near the free ends of the arm sections 14*a* and 14*b*. The screw 29 includes a threaded shaft which engages a threaded aperture in one of the arm sections (for example, arm section 14*b*) and has a head on one end that inhibits that end of the screw from passing through a aperture in the other arm section (for example, arm section 14*a*). The screw 29 may be rotated to selectively draw the arm sections 14*a* and 14*b*together. Preferably, the material from which the arm 14 is made provides sufficient elastic flexibility to allow the arm sections 14*a* and 14*b* to be drawn toward each other, when the screw 29 is tightened and to allow the arm sections 14*a* and 14*b* to automatically return towards a more separated state when the screw 29 is untightened. The head of the screw may be provided with a knob or other hand-operable feature to allow a user to easily rotate the screw by hand. The arm 14 may be made from any one or combination of a variety of materials, including, but not limited to, metal, alloys, plastics, PVC and the like.

The arm sections 14*a* and 14*b* may be provided with shaped indentations 44 for assisting in holding a sensor 16 between the arm sections. In the illustrated embodiments, the shaped indentations 44 define a generally circular cross-section, to correspond to the generally circular cross-section of the sensor 16 shown in FIG. 6. Other embodiments may employ indentations of other shapes and/or surface features (ribs, grooves or the like) to help hold the sensor 16 in place between the arm sections 14*a* and 14*b*.

With a sensor disposed in the receiving area defined by the indentations 44, the arm screw 29 may be tightened to fix and maintain the position of the sensor. The sensor 16 is provided with at least one projection to prevent the sensor from rotating, as will be described in more detail below.

Figure 7A:
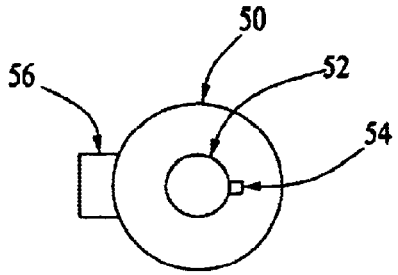
FIG. 7A shows a top-down view of a sensor according to an embodiment of the present invention.
Figure 7B:
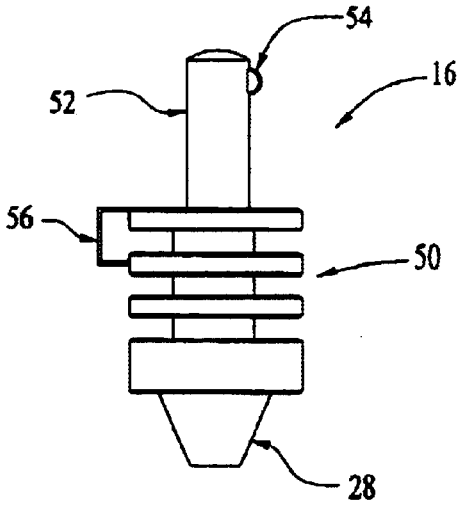
FIG. 7B shows a sensor according to an embodiment of the present invention.

A sensor 16 according to an embodiment of the present invention is shown in FIGS. 7A and 7B. The sensor 16 shown in FIG. 7B includes a sensor body 50, a shaft 52, a first projection 54 extending from the shaft 52 and a second projection 56 extending from the sensor body 50. The cushion 28 is provided at one end of the sensor 16. The first and second projections 54 and 56 may be used to prevent the sensor 16 from rotating when it is positioned in the arm 14, as will be explained in more detail below. The cushion 28 provides protection for and transfers vibrations to a piezo-electric transducing element (not shown) which is disposed between the cushion 50 and the sensor body 56.

Components of the sensor 16 shown in FIG. 7B may be made from a variety of materials. For example, the sensor shaft 52 and sensor body 50 may be made from, but not limited to, metal, alloys, plastic, PVC, combinations thereof and the like. The cushion 28 may be made from, but not limited to, synthetic rubber, rubber, plastic, PVC, combinations thereof or any other material that facilitates proper transfer of a vibration from a vibrating device to the transducing element located within the sensor 16. The projections 54 and 56 may be formed, machined or molded with the sensor body 50 and the sensor shaft 52, respectively. According to another embodiment of the present invention, the projections 54 and 56 may be discreet parts which may be fixably attached to the sensor body 50 and the sensor shaft 52, respectively.

Figure 8A:
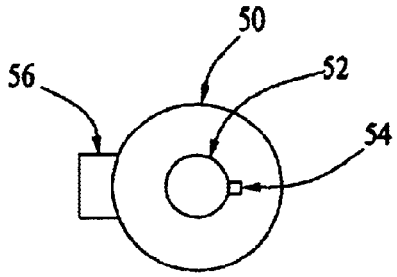
FIG. 8A shows a top-down view of a sensor according to another embodiment of the present invention.
Figure 8B:
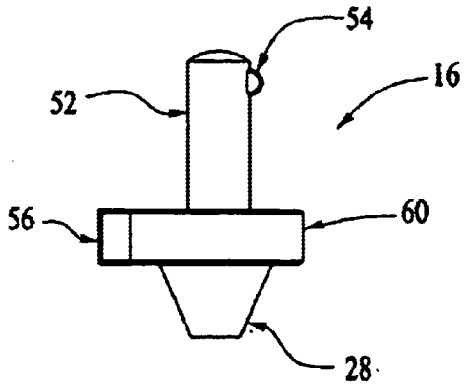
FIG. 8B shows a sensor according to another embodiment of the present invention.

The size of the sensor 16 may vary depending on its application. In preferred embodiments, the body 12 and arm 14 are configured to accommodate sensors 16 of various sizes. In this manner, the same body 12 and arm 14 may be manufactured for a variety of different sensors to accommodate a variety of different instruments. Thus, the cost of manufacturing trigger bodies 12 and arms 14 (and overall trigger devices 10) for a variety of different instruments may be minimized. For example, the sensor 16 shown in FIGS. 8A and 8B has essentially the same structure as the sensor 16 shown in FIGS. 7A and 7B, except that the sensor body 60 in FIGS. 8A and 8B has a shorter length than the sensor body 50 shown in FIGS. 7A and 7B. The smaller length of the sensor body 60 shown in FIGS. 8A and 8B facilitates the accommodation of different sizes of instruments. For example, the sensor 16 shown in FIG. 8B may be more suitable for a snare drum or a tom-tom; the sensor 16 shown in FIG. 7B may be more suitable for a bass drum due to the greater length of a bass drum rim as opposed to a snare drum rim or a tom-tom rim.

Figure 9:
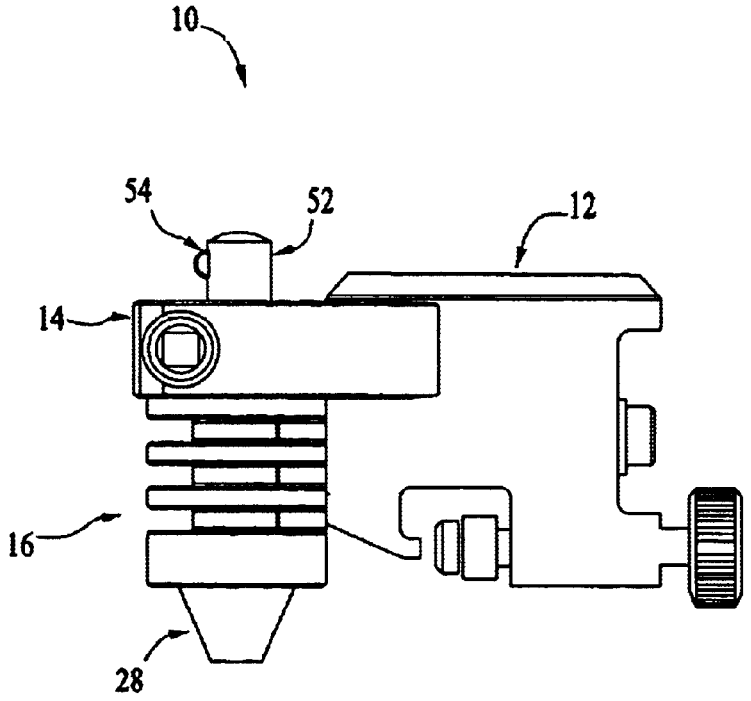
FIG. 9 shows a sensor position in an arm according to an embodiment of the present invention.
Figure 10:
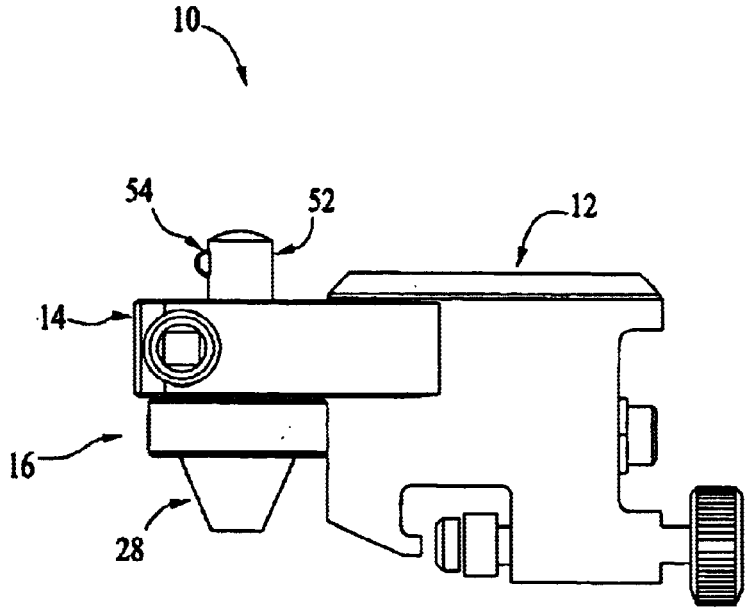
FIG. 10 shows a sensor position in an arm according to another embodiment of the present invention.

FIGS. 9 and 10 show how a sensor 16 may be adjusted according to an embodiment of the present invention. In FIG. 9, the sensor 16 has been positioned in the arm 14, in an "upper" position. As can be seen in FIG. 9, the projection 54 is located above the arm 14 and, thus, is ineffective to prevent the sensor 16 from rotating in the horizontal plane. However, the projection 56 (shown in FIGS. 8A and 8B) is located to engage the gap or slit 40 in the body 12 (shown in FIG. 4). Thus, when the sensor 16 is in an "upper" position, the projection 56 engages the slit 40 and inhibits horizontal rotation of the sensor 16, relative to the body 12. The sensor 16 may be located in this "upper" position for a variety of reasons. For example, the relationship between the drum rim and the drum head may be such that, in order to make proper contact between the drum head and the cushion 28, the sensor 16 must be disposed in the "upper" position. As another example, a player may simply desire to eliminate sensing of the drum head without removing the entire acoustic instrument triggering device 10 from the drum. If this is the case, the sensor 16 may simply be raised to the "upper" position by loosening the arm screw 14 and pulling the sensor 16 away from the drum head. An acoustic instrument triggering device 10 showing a sensor 16 with a shorter body in an "upper" position may be seen in FIG. 10.

Figure 11:
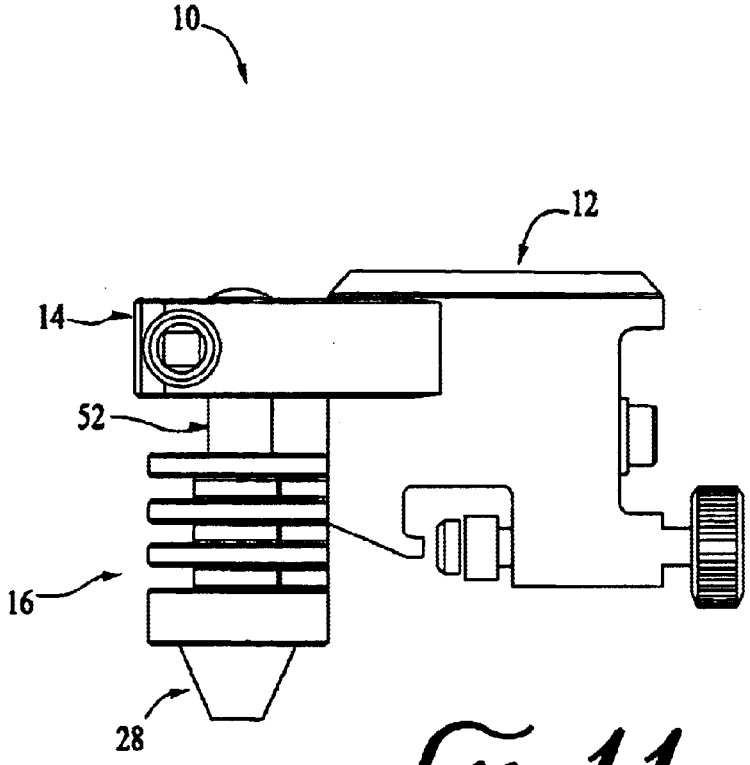
FIG. 11 shows a sensor position in an arm according to another embodiment of the present invention.
Figure 12:
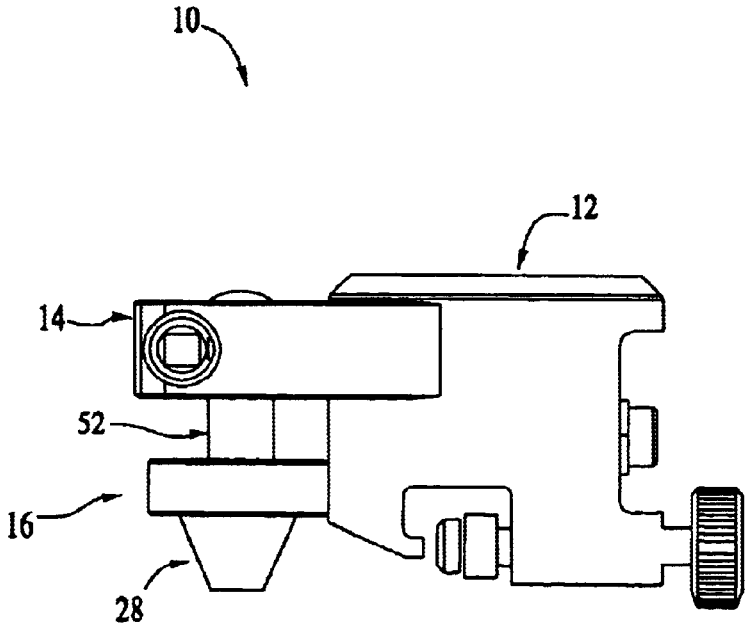
FIG. 12 shows a sensor position in an arm according to another embodiment of the present invention.
Figure 13:
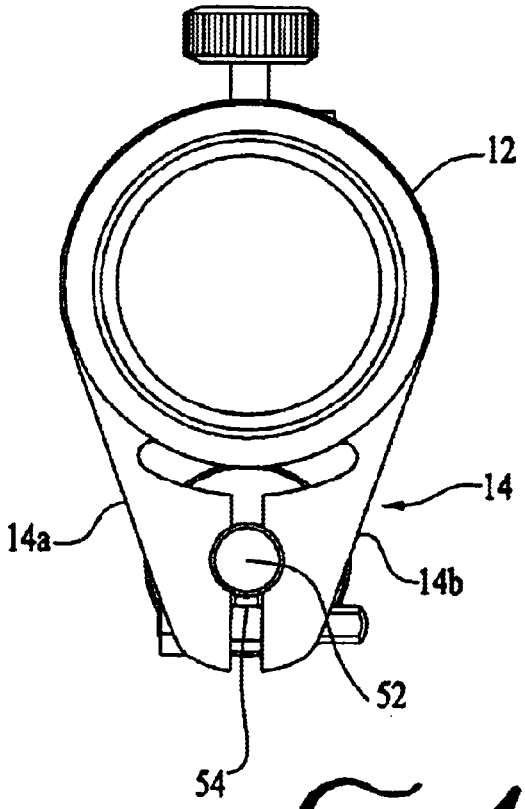
FIG. 13 shows a swelling in relation to the arm slit according to an embodiment of the present invention.

An acoustic instrument triggering device 10 with a sensor 16 in a "lower" position is shown in FIG. 11. The sensor 16 in FIG. 11 may be arranged in this "lower" position in order to accommodate the distance between the top edge of the drum rim and the drum head, thereby allowing the cushion 28 to make contact with the drum head and transfer vibrations from the drum head to the transducer present within the sensor 16. When the sensor 16 is in the position shown in FIG. 11, the first projection 54 (not visible from the side view) is disposed within the gap or slit 26 between the arm sections 14*a* and 14*b*, thereby preventing the sensor 16 from rotating in the horizontal plane relative to the body 12. FIG. 13 shows a projection 54, in relation to the arm slit 26. As can be seen in FIG. 13, when the position of the sensor 16 is such that the projection 54 is located within the arm slit 26, the sensor 16 is prevented from rotating in the horizontal plane relative to the body 12.

Figure 14:
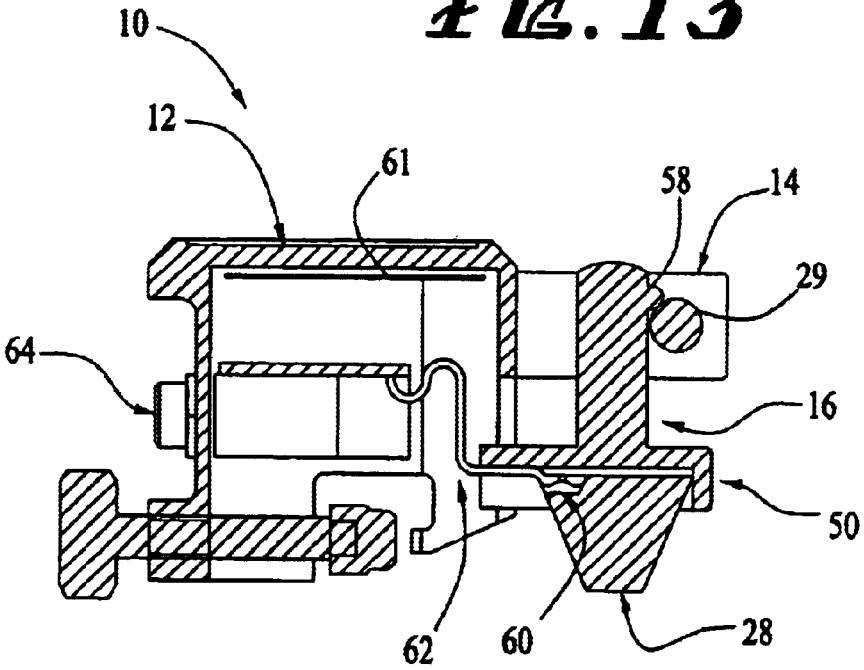
FIG. 14 shows a cutaway view of acoustic instrument triggering device according to an embodiment of the present invention.

FIG. 14 shows a cutaway view of acoustic instrument triggering device 10 according to an embodiment of the present invention. In FIG. 14, a first transducing element 60 is disposed between the cushion 28 and the sensor body 50. Connected to the transducing element 60 is a wire 62 which is routed to a jack 64. In operation, a vibration from a drum head or other vibrating device of another suitable instrument may be transferred through the cushion 28 to the transducing element 60. The transducing element 60 transduces the mechanical vibration to an electrical signal which passes through the wire 62, to the jack 64. Once the electrical signal is present at the jack 64, it may be routed to signal processing equipment, MIDI equipment and the like, where it may be used to trigger other devices or may otherwise be processed.

According to an embodiment of the present invention, as may be seen in FIG. 14, the body 12 may include a second transducing element 61. The second transducing element 61 may be used to sense vibrations on a part of an acoustic instrument in addition to or as a complement to the vibrations sensed by the first transducing element 60. For example, if the acoustic instrument triggering device 10 is positioned on a snare drum, the first transducing element 60 may sense vibrations from the head, or skin, of the snare drum while the second transducing element 61 may sense vibrations from the rim of the snare drum. Each of the signals generated by the first transducing element 60 and the second transducing element 61 may then be sent to the jack 61. The signal generated by the first transducing element 60 may be sent via the wire 62. The signal generated by the second transducing element may also be sent via wire (not shown in FIG. 14.) If two separate signals are sent to the jack 64, the jack 64 may be a stereo jack having two "hot" poles. If only a first transducing element 60 is used and only one signal is sent to the jack 64, the jack 64 may suffice as a mono jack having a single "hot" pole.

Embodiments of the present invention may also include a volume knob 70, as can be seen in FIG. 6, for example. The volume knob 70 may be used to adjust the level of the signal seen at the jack 64 that is output from the first transducing element 60, the second transducing element 61, or may be used to balance the levels of the first transducing element 60 and the second transducing element 61. This type of level control may be useful when interfacing to other equipment.

Figure 15:
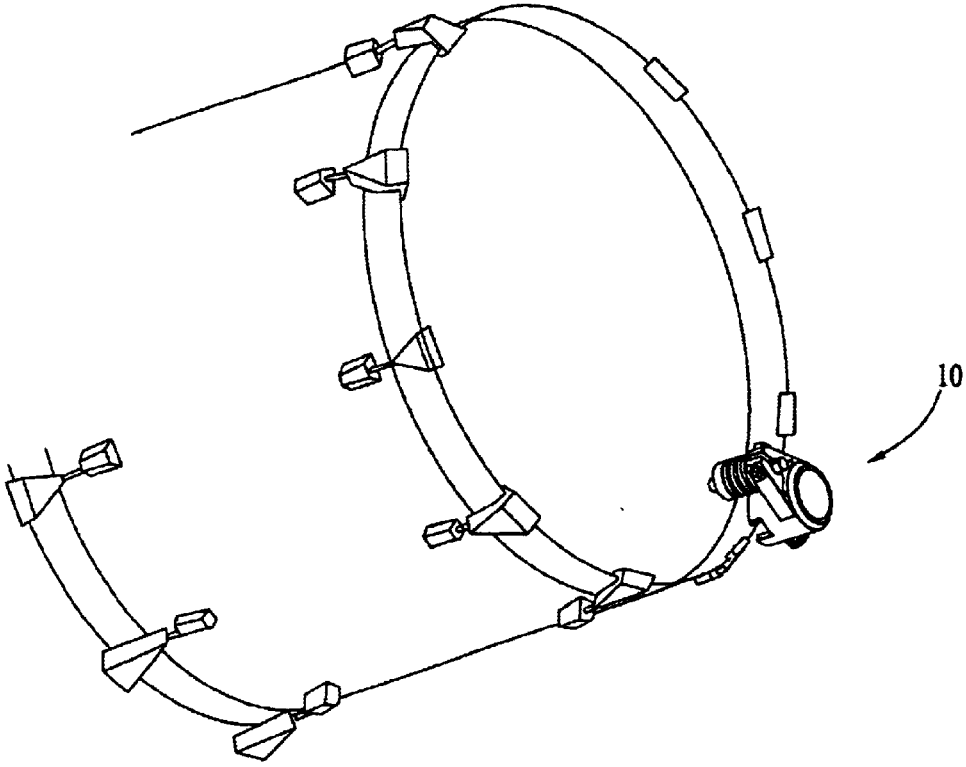
FIG. 15 shows an acoustic instrument triggering device position on a bass drum according to an embodiment of the present invention.

FIG. 15 shows an acoustic instrument triggering device 10 according to an embodiment of the present invention positioned on a bass drum. The sensor 16 of the acoustic instruments triggering device 10 includes a relatively long sensor body 50, thereby making it suitable for the relatively wide rims that are common on bass drums.

While particular embodiments of the present invention have been shown and describe, it will be obvious to those skilled in the art that the invention is not limited shown and described and that changes and modifications may be made without departing from the spirit and scope of the appended claims.

What is claimed is:

1. A triggering device for an acoustic instrument, comprising:

a body;

an arm fixedly attached to the body;

a sensor for sensing mechanical vibrations, the sensor adjustable attached to the arm, and a mounting mechanism for mounting the body to the acoustic instrument, wherein the sensor transduces mechanical vibrations from the acoustic instrument into electrical signals; and wherein the body comprises a flange and a channel for receiving a portion of the instrument, and wherein the mounting mechanism comprises a threaded screw extending through a threaded aperture in the body, the screw having a first end extending into the channel and facing the flange, the screw being rotatable to draw the first end of the screw toward the flange and to grip the portion of the instrument received in the channel between the first end of the screw and the flange.

2. A triggering device for an acoustic instrument, comprising:

a body;

an arm fixedly attached to the body;

a sensor for sensing mechanical vibrations, the sensor adjustably attached to the arm, and a mounting mechanism for mounting the body to the acoustic instrument, wherein the sensor transduces mechanical vibrations from the acoustic instrument into electrical signals; and wherein the arm comprises first and second arm sections separated by a slit, the slit having a receiving area for receiving the sensor; and an adjustable mechanism for selectively drawing the first and second arm sections toward each other to secure the sensor within the receiving area of the slit.

3. The triggering device of claim 2, wherein said mechanism for selectively drawing the first and second arm sections toward each other comprises a screw extending through the first arm section and threadably engaged with the second arm section.

4. The triggering device of claim 2, wherein the sensor comprises a shaft having a projection, the projection located to fit within the slit between the first and second arm sections, to inhibit rotation of the sensor shaft relative to the first and second arm sections.

5. The triggering device of claim 2, wherein the body of the triggering device includes a slit and the sensor further comprises a projection for engaging the slit in the body of the triggering device to inhibit rotation of the sensor relative to the body of the triggering device.

6. A triggering device for an acoustic instrument, comprising:

a body;

an arm fixedly attached to the body;

a sensor for sensing mechanical vibrations, the sensor adjustably attached to the arm, and a mounting mechanism for mounting the body to the acoustic instrument;

wherein the sensor transduces mechanical vibrations from the acoustic instrument into electrical signals; and wherein the arm has a slit within which the sensor is located.

7. The triggering device of claim 6, wherein:

the body of the triggering device includes a slit; and the sensor comprises first and second projections and is receivable within the receiving area of the arm of the triggering device in any one of multiple selectable positions, including a first position in which the first projection is received within the slit of the arm of the triggering device and a second position in which the second projection is received within the slit of the body of the triggering device.

8. A triggering device for an acoustic instrument, comprising:

a body;

an arm fixedly attached to the body;

at least one sensor for sensing mechanical vibrations, the sensor removably attached to the arm, and a mounting mechanism for mounting the body to the acoustic instrument, wherein the sensor transduces mechanical vibrations from the acoustic instrument into electrical signals; and wherein said at least one sensor comprises a plurality of sensors and wherein each sensor is removably attachable to the arm such that any one of the plurality of sensors may be attached to the arm at a given time.

9. A triggering device of claim 8, wherein said plurality of sensors comprises a first sensor having a first length dimension and a second sensor having a second length dimension that is different from the first dimension, such that sensors of different length dimensions may be attached to the arm.

10. A triggering device for an acoustic instrument, comprising:

a body;

an arm fixedly attached to the body;

at least one sensor for sensing mechanical vibrations, the sensor removably attached to the arm, and a mounting mechanism for mounting the body to the acoustic instrument, wherein the sensor transduces mechanical vibrations from the acoustic instrument into electrical signals; and wherein the arm comprises first and second arm sections separated by a slit, the slit having a receiving area for receiving the sensor, and an adjustable mechanism for selectively drawing the first and second arm sections toward each other to secure the sensor within the receiving area of the slit.

11. The triggering device of claim 10, wherein said mechanism for selectively drawing the first and second arm sections toward each other comprises a screw extending through the first arm section and threadably engaged with the second arm section.

12. A triggering device for an acoustic instrument, comprising:

a body;

an arm fixedly attached to the body, the arm having a slit for receiving the sensor;

at least one sensor for sensing mechanical vibrations, the sensor disposed within the slit in the arm, the sensor including a shaft having a projection, the projection located to fit within the slit in the arm, to inhibit rotation of the sensor shaft relative to the arm; and a mounting mechanism for mounting the body to the acoustic instrument, wherein the sensor transduces mechanical vibrations from the acoustic instrument into electrical signals.

13. The triggering device of claim 12, wherein the body of the triggering device includes a slit and the sensor further comprises a second projection for engaging the slit in the body of the triggering device to inhibit rotation of the sensor relative to the body of the triggering device.

14. The triggering device of claim 12, wherein:

the body of the triggering device includes a slit; and the sensor comprises first and second projections and is receivable within the slit of the arm of the triggering device in any one of multiple selectable positions, including a first position in which the first projection is received within the slit of the arm of the triggering device and a second position in which the second projection is received within the slit of the body of the triggering device.

15. A method of manufacturing a triggering device, comprising:

providing a body, attaching an arm in a fixed relation to the body, the arm having a slit for receiving a sensor;

receiving a sensor in the slit of the arm for selective movement relative to the arm, the sensor for sensing mechanical vibrations from the acoustic instrument into electrical signals, and attaching a securing mechanism to the arm, for fixedly securing the sensor to the arm in one of plural selectable positions relative to the arm.

16. A method of claim 15, wherein attaching a securing mechanism to the arm comprises engaging a threaded screw to the arm and selectively closing the slit around the sensor by tightening the screw.

17. The triggering device of claim 6, wherein a position of the sensor within the slit in the arm is adjustable.

* * * * *